US009335695B2

(12) United States Patent
Zhang

(10) Patent No.: US 9,335,695 B2
(45) Date of Patent: May 10, 2016

(54) IMAGING DEVICE, IMAGING CARTRIDGE, AND VERIFICATION METHOD

(71) Applicant: Apex Microelectronics Co., Ltd., Zhuhai (CN)

(72) Inventor: Linlin Zhang, Zhuhai (CN)

(73) Assignee: Apex Microelectronics Co., Ltd. (CN)

( * ) Notice: Subject to any disclaimer, the term of this patent is extended or adjusted under 35 U.S.C. 154(b) by 0 days.

(21) Appl. No.: 14/638,468

(22) Filed: Mar. 4, 2015

(65) Prior Publication Data

US 2015/0253712 A1 Sep. 10, 2015

(30) Foreign Application Priority Data

Mar. 4, 2014 (CN) ..... 2014 1 0076870

(51) Int. Cl.
*G03G 15/00* (2006.01)
*G03G 15/08* (2006.01)
*G03G 21/18* (2006.01)

(52) U.S. Cl.
CPC ..... *G03G 15/50* (2013.01); *G03G 15/0863* (2013.01); *G03G 21/1892* (2013.01)

(58) Field of Classification Search
CPC ..... G03G 15/50; G03G 2221/1823
USPC ..... 399/12, 111, 119
See application file for complete search history.

(56) References Cited

U.S. PATENT DOCUMENTS 6,984,012 B2 * 1/2006 Asauchi ..... 347/19
2004/0090832 A1 5/2004 Asauchi

FOREIGN PATENT DOCUMENTS

CN 101140553 A 3/2008
CN 101222377 A 7/2008
CN 101399854 A 4/2009
CN 201312325 Y 9/2009
CN 101561790 A 10/2009
CN 101853000 A 10/2010
CN 103268060 A 8/2013

OTHER PUBLICATIONS

Chinese Search Report for Application No. 2014100768707 dated Apr. 3, 2015.

* cited by examiner

*Primary Examiner* — Hoang Ngo
(74) *Attorney, Agent, or Firm* — Lerner, David, Littenberg, Krumholz & Mentlik, LLP

(57) ABSTRACT

An imaging device, an imaging cartridge, and a verification method are disclosed. The method comprises storing a first slave address of the imaging cartridge and configuring a first indexing rule in the imaging device. The method further comprises: an indexing step, including sending an indexing command to the imaging cartridge, generating a predicated address for the imaging cartridge based on the first indexing rule and the indexing command, and updating the first slave address of the imaging cartridge based on the predicated address; and a verification step, including judging whether a second slave address of the imaging cartridge is correct according to answer data sent by the imaging cartridge, or according to the answer data sent by the imaging cartridge as well as the first slave address of the imaging cartridge. The answer data comprise indexing feedback data that include the second slave address of the imaging cartridge, or response data with respect to an addressing command that includes the first slave address of the imaging cartridge. A counterfeit imaging cartridge which steals a slave address via the bus can be verified.

16 Claims, 8 Drawing Sheets

| Address portion | | Command portion | |
|---|---|---|---|
| 0010 | 0100 | 0010 | 0010 |

IMAGING DEVICE, IMAGING CARTRIDGE, AND VERIFICATION METHOD

CROSS-REFERENCE TO RELATED APPLICATION

The present application claims priority from Chinese Patent Application CN 201410076870.7 filed Mar. 4, 2014, the disclosure of which is hereby incorporated herein by reference.

FIELD OF THE INVENTION

The present disclosure relates to the field of imaging and developing technologies, and in particular, to an imaging device, an imaging cartridge, and a verification method.

BACKGROUND OF THE INVENTION

The development of imaging technologies has contributed to wide use of imaging devices, such as photocopiers, printers, fax machines, word processors, etc. FIG. 1 shows a structural diagram of an imaging device in the prior art. An imaging device 1 comprises imaging cartridge mounting positions 11, in which a plurality of imaging cartridges 12 are detachably mounted for accommodating imaging materials that are used by an image recording unit 13 in imaging operations. In imaging devices, especially those having a color imaging function, a plurality of imaging cartridges are generally provided for accommodating imaging materials of different colors or types, respectively.

The imaging cartridges are each provided with a corresponding chip in order to facilitate identification and operation thereof by the imaging device. The chips commonly communicate with the imaging device through a bus-sharing mode. That is, each chip is uniquely identified with a definite slave address. When the imaging device initiates communications with a specific chip, the slave address of the chip is transmitted with a command on the shared bus during the initiation of the communication. While all of the chips connected to the shared bus receive the command and the slave address from the imaging device, only the chip with the matching slave address responds to the command and sends back an acknowledgment to the imaging device.

However, such shared bus system is subject to huge potential security risks. Since each chip has a definite slave address, a counterfeit imaging cartridge having a chip that can steal a slave address identified by the imaging device provided on the bus would be able to respond to an instruction from the imaging device via the bus with request data and false data. As a result, data errors or viruses would occur in the imaging device.

Therefore, there is an urgent need of a solution to the above problem so as to enable the imaging device to verify a counterfeit imaging cartridge which steals a slave address on the shared bus.

SUMMARY OF THE INVENTION

In order to eliminate the defects existing in the prior art, the present disclosure provides a method for an imaging device to verify an imaging cartridge, comprising storing a first slave address of the imaging cartridge and configuring a first indexing rule in the imaging device, wherein the method further comprises:

an indexing step, including sending an indexing command to the imaging cartridge, generating a predicated address for the imaging cartridge based on the first indexing rule and the indexing command, and updating the first slave address of the imaging cartridge based on the predicated address; and a verification step, including judging whether a second slave address of the imaging cartridge is correct according to answer data sent by the imaging cartridge, or according to the answer data sent by the imaging cartridge as well as the first slave address of the imaging cartridge.

According to an embodiment of the present disclosure, the answer data comprise indexing feedback data that include the second slave address of the imaging cartridge, or response data with respect to an addressing command that includes the first slave address of the imaging cartridge.

The verification step comprises determining whether the second slave address of the imaging cartridge is correct by judging whether the second slave address included in the indexing feedback data that are sent by the imaging cartridge is the same as the first slave address of a corresponding imaging cartridge as stored through comparison therebetween; or sending the addressing command that includes the first slave address via a bus, and judging whether the second slave address of the imaging cartridge is correct according to whether the corresponding imaging cartridge sends back response data with respect to the addressing command.

According to an embodiment of the present disclosure, the indexing step comprises sending a plurality of consecutive indexing commands for one and the same imaging cartridge, generating a plurality of predicated addresses based on said plurality of consecutive indexing commands for said imaging cartridge, and updating a plurality of first slave addresses of said imaging cartridge based on the plurality of predicated addresses; and the verification step comprises sending addressing commands via the bus according to the plurality of first slave addresses for said imaging cartridge, and judging whether the second slave address of the imaging cartridge is correct according to whether the corresponding imaging cartridge sends back response data with respect to a latest first slave address only.

According to an embodiment of the present disclosure, the indexing step comprises sending indexing commands for a plurality of imaging cartridges, generating a plurality of predicated addresses based on said indexing commands for the plurality of imaging cartridges, and updating first slave addresses of the plurality of imaging cartridges respectively; and the verification step comprises sending addressing commands via the bus according to the slave addresses of the plurality of imaging cartridges, and judging whether second slave addresses of the imaging cartridges are correct according to whether corresponding plurality of imaging cartridges each send back response data to the respective first slave addresses.

According to an embodiment of the present disclosure, a step of visiting a non-indexed imaging cartridge is further provided between the indexing step and the verification step.

According to an embodiment of the present disclosure, the first indexing rule comprises an address generation rule or an indexing sequence table.

According to another aspect of the present disclosure, an imaging device is further provided, comprising:

a first indexing unit, used for storing a first slave address of an imaging cartridge and configuring a first indexing rule, sending an indexing command to the imaging cartridge, generating a predicated address for the imaging cartridge according to the first indexing rule and the indexing command, and updating the first slave address of the imaging cartridge based on the predicated address; and a verification unit, used for judging whether a second slave address of the imaging cartridge is correct according to answer data sent by the imaging cartridge, or according to the answer data sent by the imaging cartridge as well as the first slave address of the imaging cartridge.

According to an embodiment of the present disclosure, the answer data comprise indexing feedback data that include the second slave address of the imaging cartridge, or response data with respect to an addressing command that includes the first slave address of the imaging cartridge; and the verification unit is further used for:

determining whether the second slave address of the imaging cartridge is correct by judging whether the second slave address included in the indexing feedback data that are sent by the imaging cartridge is the same as the first slave address of a corresponding imaging cartridge as stored through comparison therebetween; or sending the addressing command that includes the first slave address via a bus, and judging whether the second slave address of the corresponding imaging cartridge is correct according to whether the imaging cartridge sends back response data with respect to the addressing command.

According to an embodiment of the present disclosure, a plurality of consecutive indexing commands is sent to one and the same imaging cartridge;

wherein the first indexing unit is further used for generating a plurality of predicated addresses according to the plurality of consecutive indexing commands for one and the same imaging cartridge, and for updating a plurality of first slave addresses of said imaging cartridge based on the plurality of predicated addresses; and wherein the verification unit is further used for sending an addressing command via the bus according to the plurality of first slave addresses for said imaging cartridge, and judging whether the second slave address of the corresponding imaging cartridge is correct according to whether the imaging cartridge feeds back response data with respect to a latest first slave address.

According to an embodiment of the present disclosure, indexing commands are sent for a plurality of imaging cartridges;

wherein the first indexing unit is further used for generating a plurality of predicated addresses based on the indexing commands for the plurality of imaging cartridges, and for updating the first salve addresses of the imaging cartridges based on the plurality of predicated addresses, respectively; and wherein the verification unit is further used for sending addressing commands via the bus according to the first slave addresses of the plurality of imaging cartridges, and judging whether the second slave addresses of corresponding imaging cartridges are correct according to whether the corresponding imaging cartridges each send back response data to respective slave addresses.

According to an embodiment of the present disclosure, the verification unit is further used for visiting a non-indexed imaging cartridge.

According to an embodiment of the present disclosure, the first indexing rule comprises an address generation rule or an indexing sequence table.

According to still another aspect of the present disclosure, a method for an imaging cartridge to accept verification of an imaging device is further provided, comprising storing a second slave address of the imaging cartridge and configuring a second indexing rule in the imaging cartridge, wherein the method further comprises:

an indexing step, including accepting an indexing command sent by the imaging device, and updating the second slave address of the imaging cartridge according to the second indexing rule and the indexing command; and an answering step, including sending answer data to the imaging device, wherein the answer data comprise indexing feedback data that include the second slave address of the imaging cartridge, or response data with respect to an addressing command which includes a first slave address of the imaging cartridge.

According to an embodiment of the present disclosure, the second indexing rule comprises an address generation rule or an indexing sequence table.

According to another aspect of the present disclosure, an imaging cartridge is further provided, comprising:

a second indexing unit, used for storing a second slave address of the imaging cartridge and configuring a second indexing rule, and for updating the second slave address based on the second indexing rule and an indexing command to be received; and an answer unit, used for sending answer data to an imaging device, wherein the answer data comprise indexing feedback data that include the second slave address of the imaging cartridge, or response data with respect to an addressing command that includes the first salve address of the imaging cartridge.

According to an embodiment of the present disclosure, the second indexing rule comprises an address generation rule or an indexing sequence table.

According to the present disclosure, indexing rules are respectively configured in the imaging device and the imaging cartridge, which can generate new slave addresses based on the indexing rules respectively. The imaging device verifies whether the new slave address of the imaging cartridge is correct by judging whether the new slave address updated by the imaging cartridge matches the slave address predicated by the imaging device, thereby improving verification rate of validity of the imaging cartridge by the imaging device. Thus, the imaging device can effectively verify a counterfeit imaging cartridge which steals a salve address via the bus.

Other features and advantages of the present disclosure will be further explained in the following description, and partly become self-evident therefrom, or be understood through implementing the present disclosure. The objectives and advantages of the present disclosure will be achieved through the structure specifically pointed out in the description, claims, and the accompanying drawings.

DETAILED DESCRIPTION OF THE EMBODIMENTS

Figure 1:
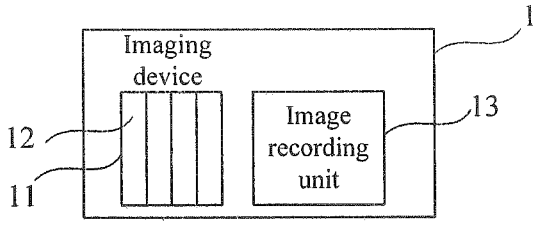
FIG. 1 shows a structural diagram of an imaging device in the prior art.

The present disclosure will be explained in details with reference to the embodiments and the accompanying drawings, whereby it can be fully understood how to solve the technical problem by the technical means according to the present disclosure and achieve the technical effects thereof, and thus the technical solution according to the present disclosure can be implemented. It is important to note that as long as there is no structural conflict, all the technical features mentioned in all the embodiments may be combined together in any manner, and the technical solutions obtained in this manner all fall within the scope of the present disclosure.

It can be seen from the prior art, since the slave address of each imaging cartridge stays constant, when an imaging device sends an addressing command to an imaging cartridge via a bus, a counterfeit imaging cartridge would steal an existing slave address and send answer data to the imaging device via the bus, thereby preventing the imaging device from verifying the counterfeit imaging cartridge.

The present disclosure aims to provide a verification method between an imaging device and an imaging cartridge based on indexing rules, which are respectively configured in the imaging device and the imaging cartridge. The imaging device and the imaging cartridge can generate new slave addresses based on the indexing rules. The imaging device then verifies validity of a new slave address of the imaging cartridge by judging whether the new slave address updated by the imaging cartridge matches a slave address predicated by the imaging device, thereby improving verification rate of validity of the imaging cartridge by the imaging device.

The imaging device according to the present disclosure can be an ink-jet printer, an ink-jet photocopier, an electrophotographic printer or photocopier, a fax machine, etc. And the imaging cartridge can be a cartridge, an ink-jet print head cartridge, an electrophotographic process cartridge, etc.

The imaging device and the imaging cartridge are respectively stored with a first slave address and a second address of the imaging cartridge, and respectively provided with a first indexing rule and a second indexing rule.

Specifically, the first slave address and the second slave address can be configured as a same initial address. When the imaging device and the imaging cartridge are power-on or in a reset operation, the first slave address of the imaging cartridge stored in the imaging device and the second slave address of the imaging cartridge stored in the imaging cartridge are both configured to be the initial address. The imaging device can predict a new slave address of the imaging cartridge according to the initial address and the first indexing rule.

The first indexing rule configured in the imaging device is the same as the second indexing rule configured in the imaging cartridge, both as a same address generation rule. Alternately, the first indexing rule configured in the imaging device is in the form of an indexing sequence table, while the second indexing rule configured in the imaging cartridge is an address generation rule. The indexing sequence table is stored with all new slave addresses that can be generated by the imaging cartridge based on the address generation rule.

Figure 2A:
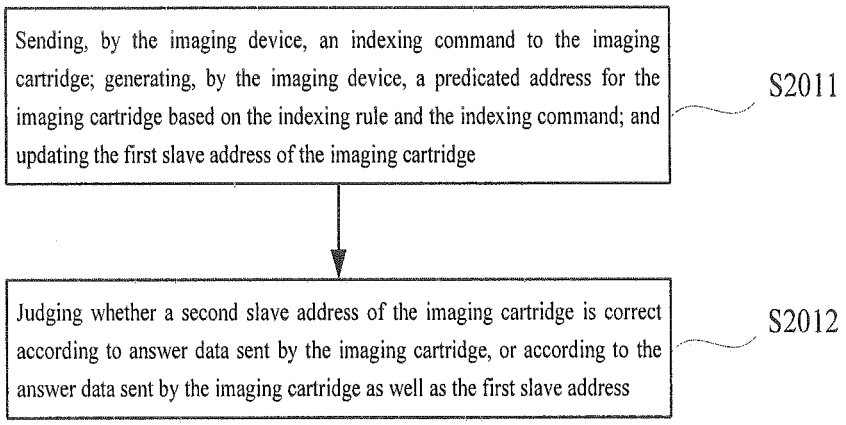
FIG. 2*a* shows a flow chart of a method for an imaging device to verify an imaging cartridge provided in the present disclosure.

FIG. 2*a* shows a flow chart of a method for the imaging device to verify the imaging cartridge provided in the present disclosure, specifically comprising the following steps.

In step S2011, an indexing step, the imaging device sends an indexing command to the imaging cartridge, generates a predicated address for the imaging cartridge according to the first indexing rule and the indexing command, and updates the first slave address of the imaging cartridge based on the predicated address.

In step S2012, a verification step, the imaging device judges whether the second salve address of the imaging cartridge is correct, according to answer data sent back by the imaging cartridge, or according to the answer data sent back by the imaging cartridge as well as the first slave address of the imaging cartridge stored in the imaging device.

Specifically, the answer data comprise indexing feedback data that include the second slave address of the imaging cartridge, or comprise response data with respect to the addressing command that includes the first slave address of the imaging cartridge.

After updating the second salve address, the imaging cartridge sends the indexing feedback data that include a new second slave address to the imaging device. The imaging device determines whether the second slave address of the imaging cartridge is correct by judging whether the second slave address included in the indexing feedback data that are sent by the imaging cartridge is the same as the first slave address of a corresponding imaging cartridge stored in the imaging device through comparison therebetween.

Optionally, the imaging device sends the addressing command which includes the first slave address via a bus, and determines whether the second slave address of the imaging cartridge is correct by judging whether a corresponding cartridge feeds back response data with respect to the addressing command.

Figure 2B:
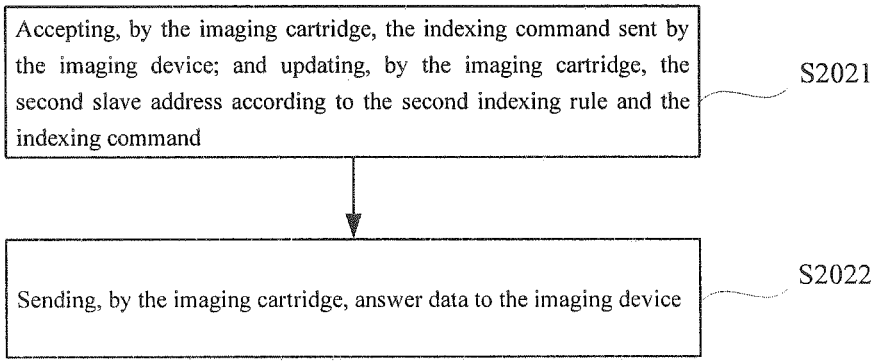
FIG. 2*b* shows a flow chart of a method for the imaging cartridge to accept verification by the imaging device provided in the present disclosure.

FIG. 2*b* shows a flow chart of a method for the imaging cartridge to accept verification by the imaging device provided in the present disclosure, specifically comprising the following steps.

In step S2021, an indexing step, the imaging cartridge accepts the indexing command sent by the imaging device, and updates the second slave address of the imaging cartridge according to the second indexing rule and indexing command.

In step S2022, an answering step, the imaging cartridge sends answer data to the imaging device.

Specifically, the answer data comprise the indexing feedback data that include the second slave address of the imaging cartridge, or the response data with respect to the addressing command that includes the first slave address of the imaging cartridge.

Figure 3:
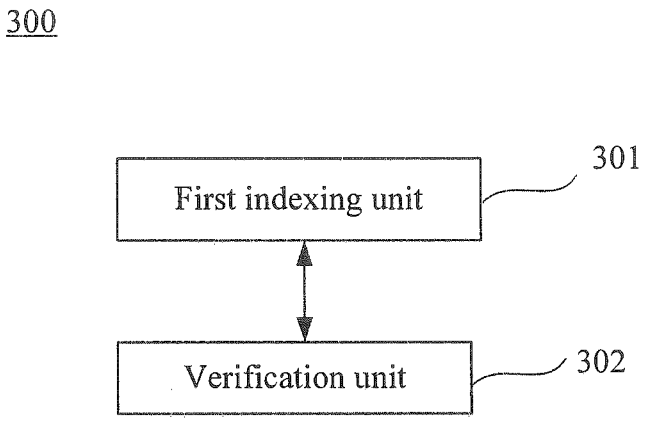
FIG. 3 shows a structural diagram of the imaging device provided in the present disclosure.

The present disclosure further provides an imaging device, which is electrically connected to a plurality of imaging cartridges via a bus. FIG. 3 shows a structural diagram of an imaging device 300 provided in the present disclosure. The imaging device 300, as indicated in the figure, comprises a first indexing unit 301 and a verification unit 302.

The first indexing unit 301 is used for storing a first slave address of a specified imaging cartridge and configuring a first indexing rule, sending an indexing command to the imaging cartridge, generating a predicated address for the specified imaging cartridge according to the first indexing rule and the indexing command, and updating the first slave address of the imaging cartridge based on the predicated address.

Preferably, the first indexing unit 301 can store a plurality of first slave addresses of one and the same imaging cartridge, and first slave addresses of different imaging cartridges.

The verification unit 302 is used for judging whether a second slave address of the imaging cartridge is correct according to answer data sent by the imaging cartridge, or according to the answer data sent by the imaging cartridge as well as the first slave address of the imaging cartridge.

Specifically, the answer data comprise indexing feedback data that include the second slave address of the imaging cartridge, or response data with respect to an addressing command that includes the first slave address of the imaging cartridge.

The verification unit 302 determines whether the second slave address of the imaging cartridge is correct by judging whether the second slave address included in the indexing feedback data which are sent by the imaging cartridge is the same as the first slave address of a corresponding imaging cartridge as stored through comparison therebetween.

Alternately, the verification unit 302 sends the addressing command that includes the first slave address via the bus, and judges whether the second slave address of the imaging cartridge is correct according to whether the imaging cartridge sends response data with respect to the addressing command.

Figure 4A:
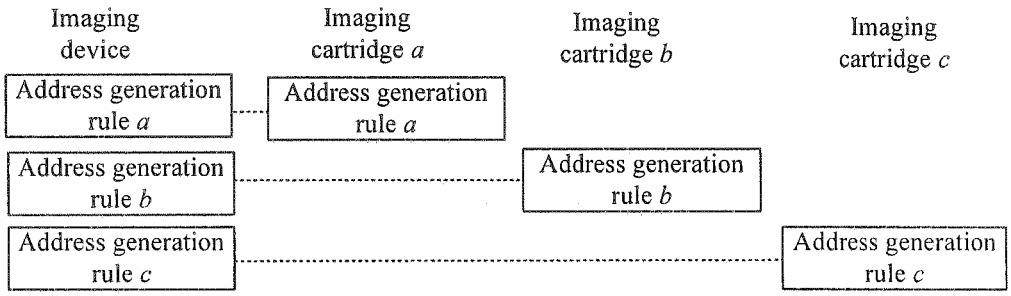
FIG. 4*a* shows a table of an address generation rule that is stored in a first indexing unit provided in the present disclosure.
Figure 4B:
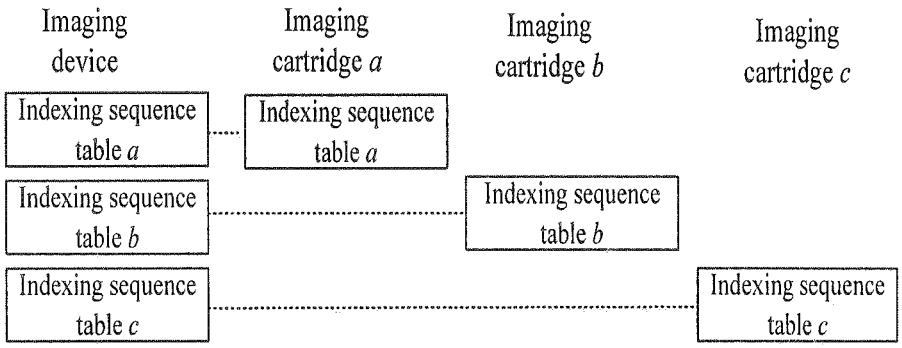
FIG. 4*b* shows an indexing sequence table that is stored in the first indexing unit provided in the present disclosure.
Figures 5, 6:
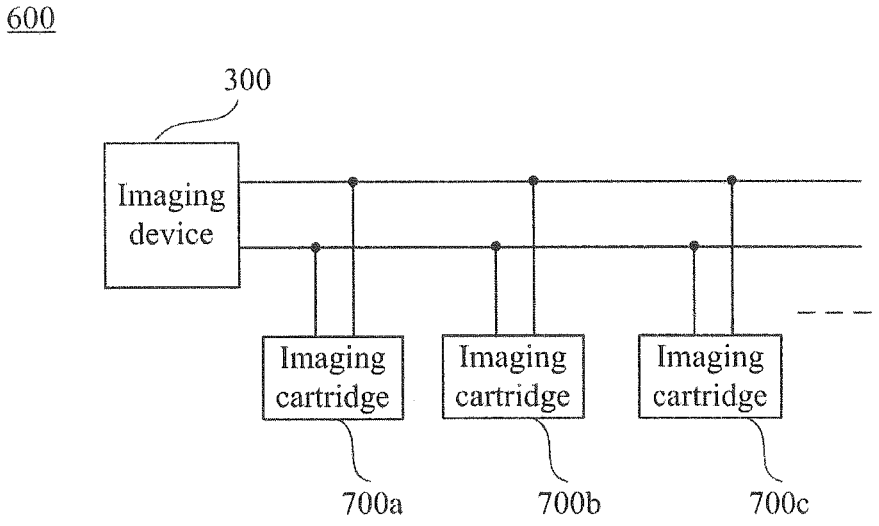
FIG. 5 schematically shows an indexing command provided in the present disclosure.
FIG. 6 schematically shows the structure of an imaging system provided in the present disclosure.

In the embodiment as shown in FIG. 3, the first indexing rule configured in the first indexing unit 301 comprises an address generation rule or an indexing sequence table. The first indexing unit 301 generates a predicated address for the imaging cartridge based on the address generation rule or the indexing sequence table. A table of the address generation rule and the indexing sequence table are shown in FIG. 4*a* and FIG. 4*b*, respectively. And FIG. 5 shows a format of the command sent to the imaging cartridge by the imaging device, including an address portion and a control portion. The address portion shows the first slave address, and is used for indicating the imaging cartridge to be accessed, while the control portion is used for instructing the imaging cartridge to complete specific operations, such as reading data, writing data, and the indexing operations as described above. Detailed explanations will be provided in the following.

FIG. 6 schematically shows the structure of an imaging system 600 provided in an embodiment of the present disclosure, and will be used for illustrating the verification method provided in the present disclosure in detail. The imaging system 600 comprises an imaging device 300 and a plurality of imaging cartridges 700*a*, 700*b*, 700*c*, and the like that are electrically connected to the imaging device via a bus.

Figure 7:
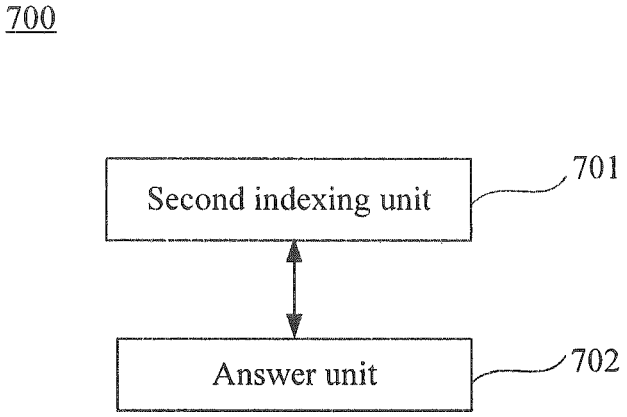
FIG. 7 schematically shows the structure of the imaging cartridge provided in the present disclosure.

FIG. 7 schematically shows the structure of an imaging cartridge 700 provided in an embodiment of the present disclosure.

The imaging cartridge 700 is provided with a second indexing unit 701 therein, which is used for storing a second slave address of the imaging cartridge and configuring a second indexing rule, and for updating the second slave address based on the second indexing rule and an indexing command sent by a first indexing unit 301.

The imaging cartridge 700 is further provided with an answer unit 702 therein, which is used for sending answer data to the imaging device 300.

It should be noted that, according to the embodiment as shown in FIG. 7, the first indexing rule configured in the first indexing unit 301 of the imaging device 300 can be the same as the second indexing rule configured in the second indexing unit 701 of the imaging cartridge 700, both as a same address generation rule shown in FIG. 4*a*. The first indexing unit 301 is stored with address generation rules corresponding to a plurality of imaging cartridges, and correspondingly, the second address units 701 of the imaging cartridge are stored with respective address generation rules. The address generation rules of the plurality of imaging cartridges can be the same as or different from each other. For example, with respect to the imaging cartridge 700*a*, an address generation rule a thereof can be an original value of its slave address added with 7, while an address generation rule b of the imaging cartridge 700*b* can be an original value of its slave address added with 9.

Reference will be made to the imaging cartridge 700*a* in the following for explanation of an indexing step based on the address generation rule.

It can be supposed that the imaging cartridge 700*a* has an initial slave address as "0010 0100", and the address generation rule stipulates adding 7 to the original value of the slave address. When the first indexing unit 301 of the imaging device 300 sends an indexing command to the imaging cartridge 700*a*, the imaging cartridge 700*a* generates a new slave address "0010 1100" according to the address generation rule a, and updates the second slave address stored in the second indexing unit 701 into the new slave address "0010 1100". The imaging device 300 generates a predicated address "0010 1100" for the imaging cartridge 700*a* according to the address generation rule a, and updates the first slave address of the imaging cartridge 700*a* stored in the first indexing unit 301 into the predicated address "0010 1100".

Optionally, the first indexing rule and the second indexing rule can be the same, both as a same indexing sequence table as shown in FIG. 4*b*. FIG. 4*b* shows the indexing sequence table stored both in the first indexing unit 301 of the imaging device 300 and in the second indexing unit 701 of the imaging cartridge 700 according to the embodiment shown in FIG. 7. The first indexing unit 301 is stored with a plurality of indexing sequence tables in correspondence with a plurality of imaging cartridges, and correspondingly, the second indexing unit 701 of the imaging cartridge is stored with a respective indexing sequence table. The indexing sequence table of FIG. 4*b* constitutes a look-up table filled with a plurality of slave addresses respectively numbered. For example, the above salve address "0010 0100" can be stored at a place 001, and the slave address "0010 1100" can be stored at a place 002 in the indexing sequence table.

Reference will be made to the imaging cartridge 700*a* in the following for explanation of an indexing step based on the indexing sequence table.

When the first indexing unit 301 of the imaging device 300 sends an indexing compound to the imaging cartridge 700*a*, the imaging cartridge 700*a*, according to an indexing sequence table a, selects a next new slave address "0010 1100" in an ascending order, and then updates the second slave address stored in the second indexing unit 701 into the new slave address "0010 1100". The imaging device 300, according to the indexing sequence table a, selects the predicated address "0010 1100" for the imaging cartridge 700*a* in an ascending order, and then updates the first slave address of the imaging cartridge 700*a* stored in the first indexing unit 301 into the predicated address "0010 1100".

Optionally, the first indexing rule and the second indexing rule can be different from each other. For example, the first indexing rule can be configured as an address generation rule, while the second indexing rule can be configured as an indexing sequence table; alternately, the first indexing rule can be configured as an indexing sequence table, while the second indexing rule can be configured as an address generation rule. All new slave addresses that can be generated based on the address generation rule can be stored in the indexing sequence table, and numbered in a sequence as being generated.

FIG. 5 schematically shows an indexing command sent from the imaging device to the imaging cartridge according to the present embodiment, comprising an address portion and a command portion, wherein the address portion "0010 0100" is the first slave address of the imaging cartridge stored in the first indexing unit 301, while the command portion "0010 0010" indicates operations for address change.

In the following, reference will be made to specific embodiments to explain the verification step of the present disclosure in detail.

Embodiment 1

A specific verification method will be provided in connection with an imaging system as shown in FIG. 6. An imaging device 300 determines whether a second slave address of an imaging cartridge is correct by judging whether answer data sent by an imaging cartridge 700*a* are the same as a first slave address of the imaging cartridge 700*a* stored in the imaging device 300 through comparison therebetween.

Figure 8:
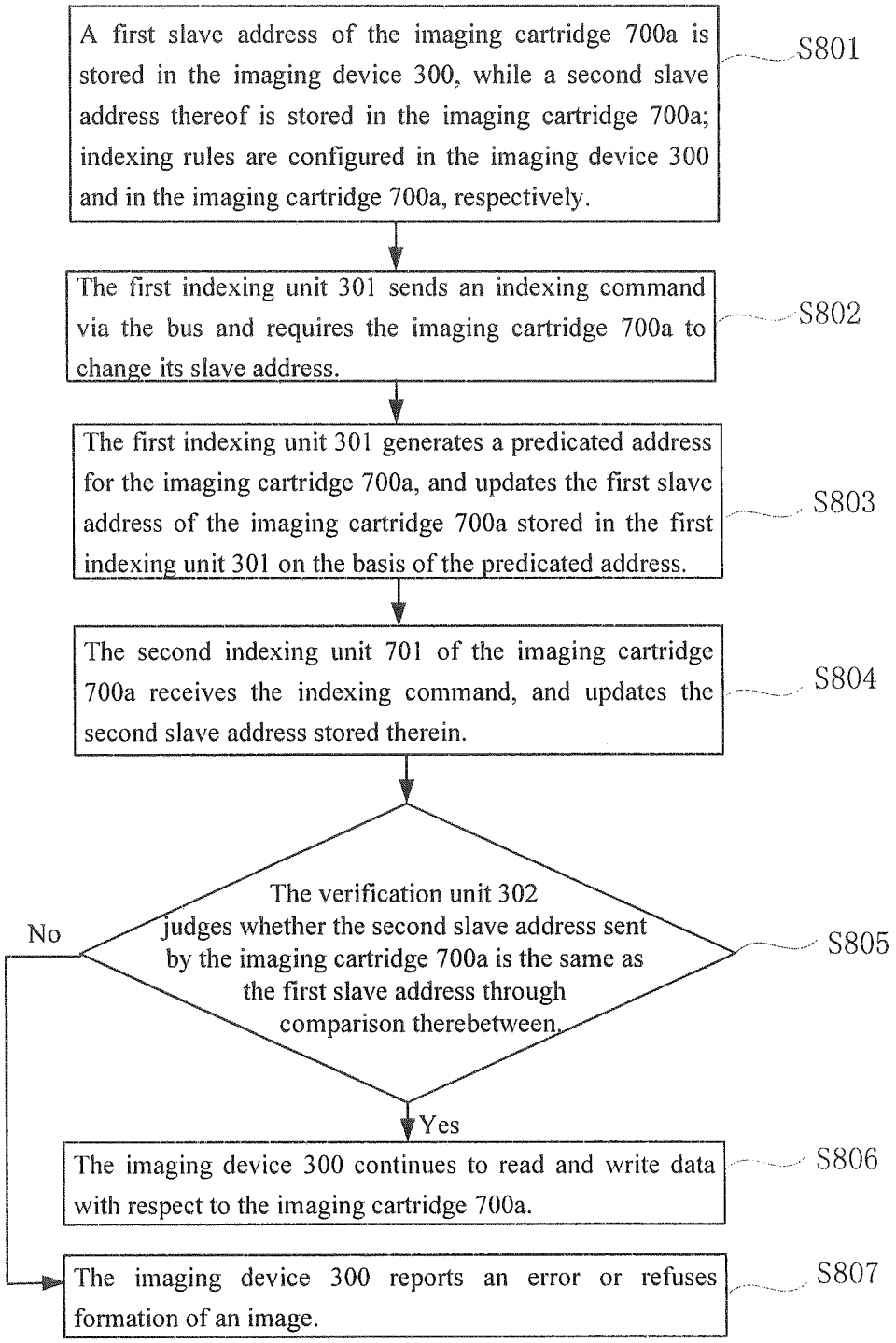
FIG. 8 shows a flow chart of a verification method of Embodiment 1.

FIG. 8 shows a flow chart of the verification method according to this embodiment, specifically comprising the following steps.

In step S801, an initialization step, a first indexing unit 301 of the imaging device 300 stores a first slave address of the imaging cartridge 700*a*, while a second indexing unit 701 of the imaging cartridge 700*a* stores a second slave address of the imaging cartridge. In addition, a first indexing rule is configured in the first indexing unit 301 of the imaging device 300, while a second indexing rule is configured in the second indexing unit 701 of the imaging cartridge 700*a*.

Preferably, in this step, a verification unit 302 of the imaging device 300 sends an addressing command to the imaging cartridge 700*a*, and an answer unit 702 of the imaging cartridge 700*a* replies with response data 0 or 1, such that the imaging device 300 and the imaging cartridge 700*a* are connected with each other via a bus.

Specifically, the imaging device 300 configures an initial address for the imaging cartridge 700*a*, and stores the initial address in the first indexing unit 301 of the imaging device 300 as the first slave address of the imaging cartridge 700*a*. And the imaging cartridge 700*a* stores the initial address in the second indexing unit 701 as the second slave address of the imaging cartridge 700*a*. When the imaging device 300 and the imaging cartridge 700*a* are power-on or in a reset operation, the first slave address and the second slave address are both configured to be the initial address.

The verification unit 302 of the imaging device 300 sends an addressing command via the bus, wherein an address portion of the addressing command is the initial address of the imaging cartridge 700*a*, while a command portion thereof indicates a call, i.e., requesting the imaging cartridge 700*a* to return response data.

The second indexing unit 701 of the imaging cartridge 700*a* compares the initial address contained in the addressing command that has been received with the second slave address. If the two are the same, then the answer unit 702 replies with response data 0 or 1 via the bus to the imaging device 300, thereby confirming that the imaging cartridge 700*a* has already been mounted to the imaging device. If they are different from each other, then no response data will be sent by the answer unit 702.

In step S802, the first indexing unit 301 of the imaging device 300 sends an indexing command via the bus, and requires the imaging cartridge 700*a* to change its slave address.

Specifically, the address portion of the indexing command is the initial address of the imaging cartridge 700*a*.

In step S803, the first indexing unit 301 generates a predicated address for the imaging cartridge 700*a* based on the first indexing rule, and updates the first slave address of the imaging cartridge 700*a* stored in the first indexing unit 301 on the basis of the predicated address.

In step S804, the second indexing unit 701 of the imaging cartridge 700*a* receives the indexing command, and updates the second slave address stored in the second indexing unit 701 according to the second indexing rule.

In step S805, an answer unit 702 of the imaging cartridge 700*a* responds to the imaging device 300 with indexing feedback data that include the second slave address. And the verification unit 302 judges whether the second slave address included in the indexing feedback data that are sent by the imaging cartridge 700*a* is the same as the first slave address of the imaging cartridge 700*a* stored in the first indexing unit 301 of the imaging device 300 through comparison therebetween. If yes, the second slave address of the imaging cartridge 700*a* is correct, followed by execution of step S806, while if no, the second slave address of the imaging cartridge 700*a* is incorrect, such that the imaging cartridge 700*a* is invalid and step S807 will be executed.

In step S806, the imaging device 300 continues to read and write data with respect to the imaging cartridge 700*a*.

In step S807, the imaging device 300 reports an error or refuses formation of an image.

Step S803 can be performed after step S804 and before step S805.

In this embodiment, only a valid imaging cartridge can store a second indexing rule, so as to further generate a slave address that matches a predicated address of the imaging device. The imaging device can effectively determine a counterfeit imaging cartridge by judging whether the first slave address and the second slave address are the same through comparison therebetween.

Embodiment 2

Another specific verification method will be provided in connection with the imaging system as shown in FIG. 6. An imaging device 300 sends a plurality of consecutive indexing commands to an imaging cartridge 700*a*, and calls the imaging cartridge 700*a* each time with an updated new address that has been predicated, so as to determine validity of the imaging cartridge 700*a*.

Figure 9:
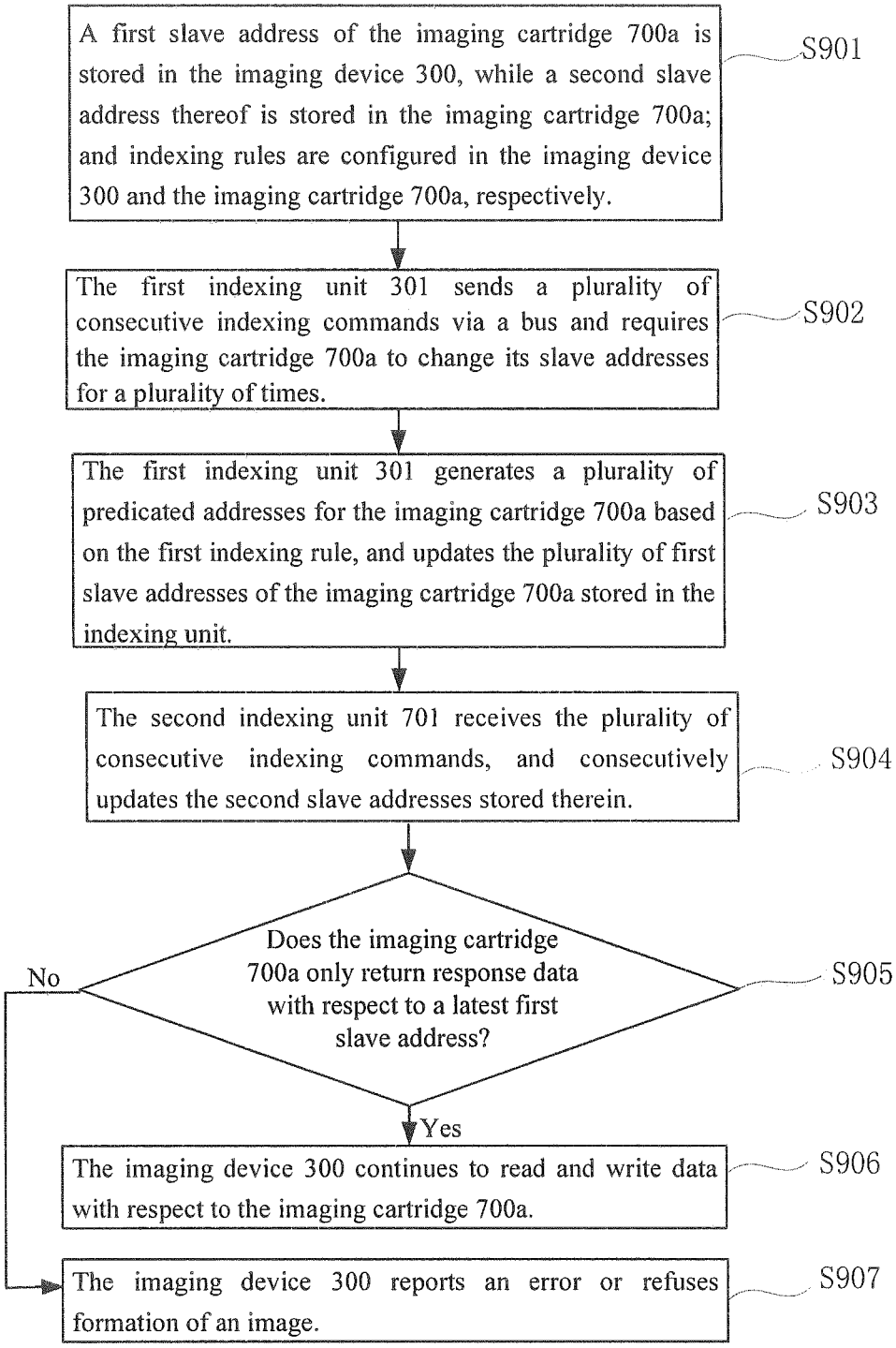
FIG. 9 shows a flow chart of a verification method of Embodiment 2.

FIG. 9 shows a flow chart of the verification method according to this embodiment, specifically comprising the following steps.

In step S901, an initialization step, a first indexing unit 301 of the imaging device 300 stores a first slave address of the imaging cartridge 700*a*, while a second indexing unit 701 of the imaging cartridge 700*a* stores a second slave address of the imaging cartridge. In addition, a first indexing rule is configured in the first indexing unit 301 of the imaging device 300, while a second indexing rule is configured in the second indexing unit 701 of the imaging cartridge 700*a*.

Preferably, in this step, a verification unit 302 of the imaging device 300 sends an addressing command to the imaging cartridge 700*a*, and an answer unit 702 of the imaging cartridge 700*a* replies with response data. Specific procedures are the same as those described above in step S801 of Embodiment 1, and therefore will not be repeated herein.

In step S902, the first indexing unit 301 of the imaging device 300 sends a plurality of consecutive indexing commands via a bus, and requires the imaging cartridge 700*a* to change its slave addresses for a plurality of times.

In step S903, the first indexing unit 301 generates a plurality of predicated addresses for the imaging cartridge 700*a* based on the first indexing rule, and updates the plurality of first slave addresses of the imaging cartridge 700*a* stored in the first indexing unit 301 based on the plurality of predicated addresses.

In step S904, the second indexing unit 701 of the imaging cartridge 700*a* receives the plurality of consecutive indexing commands, and consecutively updates the second slave addresses stored in the second indexing unit 701 according to the second indexing rule.

In step S905, the verification unit 302 of the imaging device 300 randomly sends an addressing command via the bus based on the plurality of first slave addresses for the imaging cartridge 700*a* stored in the first indexing unit 301, and judges whether the answer unit 702 of the imaging cartridge 700*a* only returns response data with respect to a latest first slave address. If yes, then the second slave address of the imaging cartridge 700*a* is correct, such that step S906 will be executed, while if no, i.e., the imaging cartridge 700*a* does not return response data with respect to the latest first slave address, then the second slave address of the imaging cartridge 700*a* is incorrect, such that the imaging cartridge 700*a* is invalid and step S907 will be executed.

In step S906, the imaging device 300 continues to read and write data with respect to the imaging cartridge 700*a*.

In step S907, the imaging device 300 reports an error or refuses formation of an image.

Step S903 can be performed after step S904 and before step S905.

In this embodiment, the imaging device does not have to read an updated salve address of an imaging cartridge, but can directly call the imaging cartridge via a bus by continuously sending indexing commands and using a predicated new slave address, and detect whether there will be a response. Since only a valid imaging cartridge can store a second indexing rule, so as to generate a slave address that matches the predicated address of the imaging device, a counterfeit imaging device can thereby be effectively determined.

Embodiment 3

A still another specific verification method will be provided in connection with the imaging system as shown in FIG. 6. An imaging device 300 sends indexing commands to imaging cartridges 700*a* and 700*b*, and calls the imaging cartridges 700*a* and 700*b* using updated addresses that have been predicated, so as to judge validity of the imaging cartridges, respectively.

Figure 10:
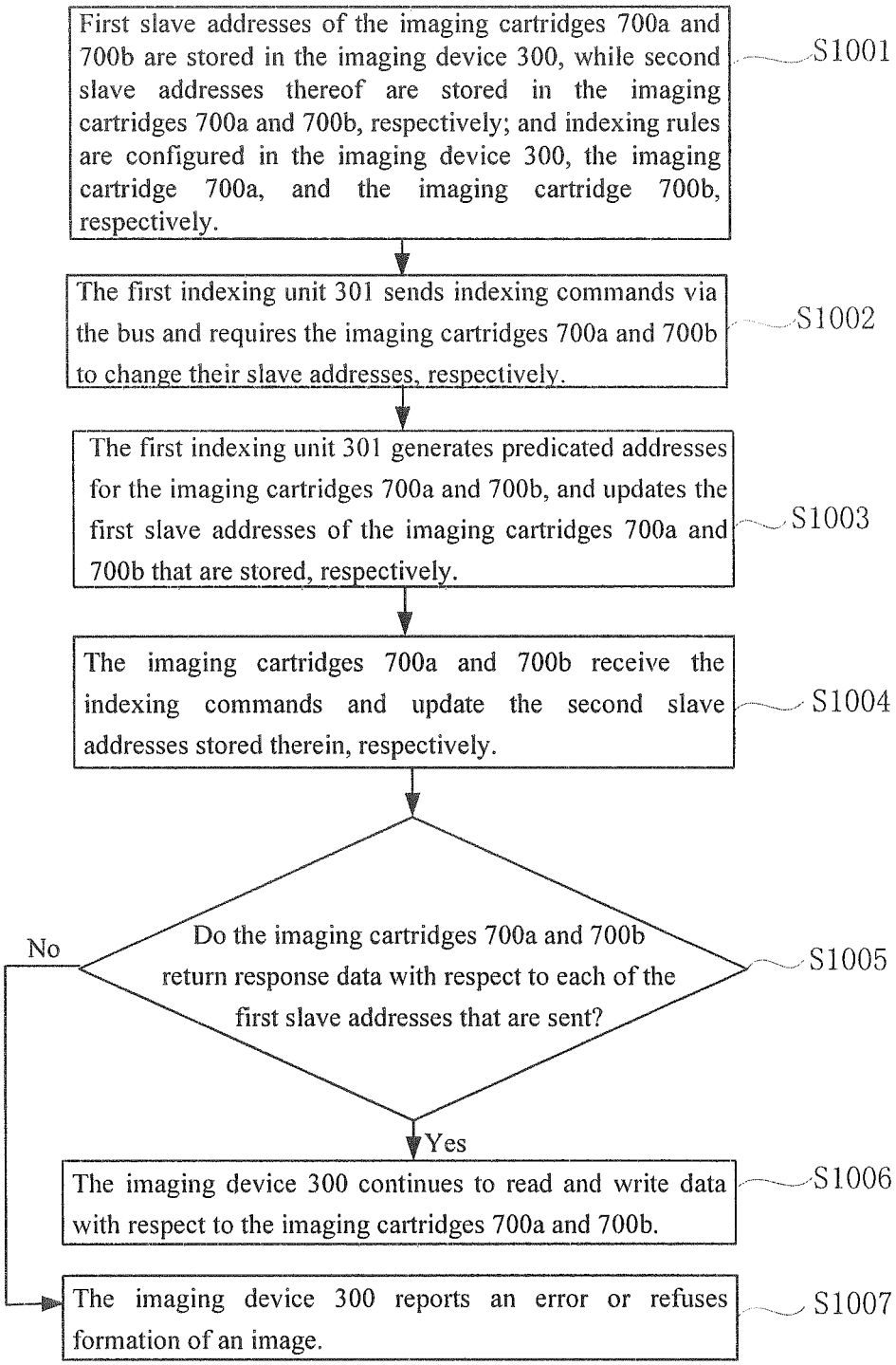
FIG. 10 shows a flow chart of a verification method of Embodiment 3.

FIG. 10 shows a flow chart of the verification method according to this embodiment, specifically comprising the following steps.

In step S1001, an initialization step, a first indexing unit 301 of the imaging device 300 stores a first slave address of the imaging cartridge 700*a* and a first salve address of the imaging cartridge 700*b*, while a second indexing unit of the imaging cartridge 700*a* stores a second slave address of the imaging cartridge 700*a*, and a second indexing unit of the imaging cartridge 700*b* stores a second slave address of the imaging cartridge 700*b*. In addition, a first indexing rule is configured in the first indexing unit 301 of the imaging device 300, while a second indexing rule is configured in the second indexing unit of the imaging cartridge 700*a*, and a second indexing rule is configured in the second indexing unit of the imaging cartridge 700*b*.

Preferably, in this step, a verification unit 302 of the imaging device 300 sends addressing commands to the imaging cartridge 700*a* and the imaging cartridge 700*b* respectively, and a response unit of the imaging cartridge 700*a* and that of the imaging cartridge 700*b* reply with response data respectively, such that the imaging device 300, the imaging cartridge 700*a*, and the imaging cartridge 700*b* are connected with one another via a bus.

Specifically, the imaging device 300 configures an initial address for the imaging cartridge 700*a*, and stores the initial address in the first indexing unit 301 of the imaging device 300 as the first slave address of the imaging cartridge 700*a*. The imaging cartridge 700*a* stores the initial address in the second indexing unit as the second slave address of the imaging cartridge 700*a*. The verification unit 302 of the imaging device 300 sends an addressing command which includes the initial address of the imaging cartridge 700*a*.

The second indexing unit of the imaging cartridge 700*a* compares the initial address contained in the addressing command that has been received with the second slave address. If the two are the same, then the response unit will reply to the imaging device 300 with response data 0 or 1 via the bus, thereby confirming that the imaging cartridge 700*a* has been mounted to the imaging device.

Similarly, the imaging device 300 configures an initial address for the imaging cartridge 700*b*, and sends an addressing command to the imaging cartridge 700*b*. The imaging cartridge 700*b* compares the initial address contained in the addressing command that has been received with the second slave address stored in a second address storage unit. If the two are the same, the imaging cartridge 700*b* replies to the imaging device 300 with response data 0 or 1 via the bus, thereby confirming that the imaging cartridge 700*b* has already been mounted to the imaging device.

In step S1002, the first indexing unit 301 of the imaging device 300 sends indexing commands via the bus and requires the imaging cartridges 700*a* and 700*b* to change their slave addresses, respectively.

In step S1003, the first indexing unit 301 of the imaging device 300 generates predicated addresses for the imaging cartridges 700*a* and 700*b* respectively based on the first indexing rules, and updates the first slave addresses of the imaging cartridges 700*a* and 700*b* stored in the first indexing unit 301 based on the predicated addresses, respectively.

In step S1004, the second indexing unit of the imaging cartridge 700*a* receives the indexing command, and updates the second slave address stored in the second indexing unit according to the second indexing rule in the imaging cartridge 700*a*.

And the second indexing unit of the imaging cartridge 700*b* receives the indexing command, and updates the second slave address stored in the second indexing unit according to the second indexing rule of the imaging cartridge 700*b*.

In step S1005, the verification unit 302 of the imaging device 300 randomly sends an addressing command based on the first slave address with respect to the imaging cartridge 700*a* and the first slave address with respect to the imaging cartridge 700*b* that are stored in the first indexing unit 301. That is, the verification unit 302 randomly selects one from the updated first slave address of the imaging cartridge 700*a* and the updated first slave address of the imaging cartridge

700*b* as the slave address included in the addressing command, and sends the addressing command via the bus. The verification unit will judge whether response data are sent back each time. If yes, it will be determined that the second slave addresses of the imaging cartridges 700*a* and 700*b* are both correct, followed by execution of step S1006. If no, the imaging cartridges 700*a* and 700*b* will be judged as invalid, followed by execution of step S1007.

Specifically, if response data are sent back merely to the addressing command of the first slave address with respect to the imaging cartridge 700*a*, then the second salve address of the imaging cartridge 700*a* is judged as correct, while the second slave address of the imaging cartridge 700*b* is incorrect and the imaging cartridge 700*b* is therefore invalid, followed by execution of step S1007.

If response data are send back merely to the addressing command of the first slave address with respect to the imaging cartridge 700*b*, then the second slave address of the imaging cartridge 700*b* is judged as correct, while the second slave address of the imaging cartridge 700*a* is incorrect and the imaging cartridge 700*a* is therefore invalid, followed by execution of step S1007.

If no response data are sent back to the addressing command at any time, then the imaging cartridges 700*a* and 700*b* are both judged to be invalid, followed by execution of step S1007.

In step S1006, the imaging device 300 continues to read and write data with respect to the imaging cartridges 700*a* and 700*b*.

In step S1007, the imaging device 300 reports an error or refuses formation of an image.

Step S1003 can be performed after step S1004 and before step S1005.

In this embodiment, the imaging device verifies correctness, i.e., validity of two or more imaging cartridges in one verification step, thereby facilitating effective validity verification of all imaging cartridges with reduced verification time.

Embodiment 4

A still another specific verification method will be provided in connection with the imaging system as shown in FIG. 6. An imaging device 300 sends an indexing command to an imaging cartridge 700*a*. After the imaging cartridge 700*a* updates its slave address, the imaging device 300 first communicates with a non-indexed imaging cartridge 700*b* via a bus, and then calls the imaging cartridge 700*a* using an updated address that has been predicated, so as to judge validity of the imaging cartridge 700*a*.

Figure 11:
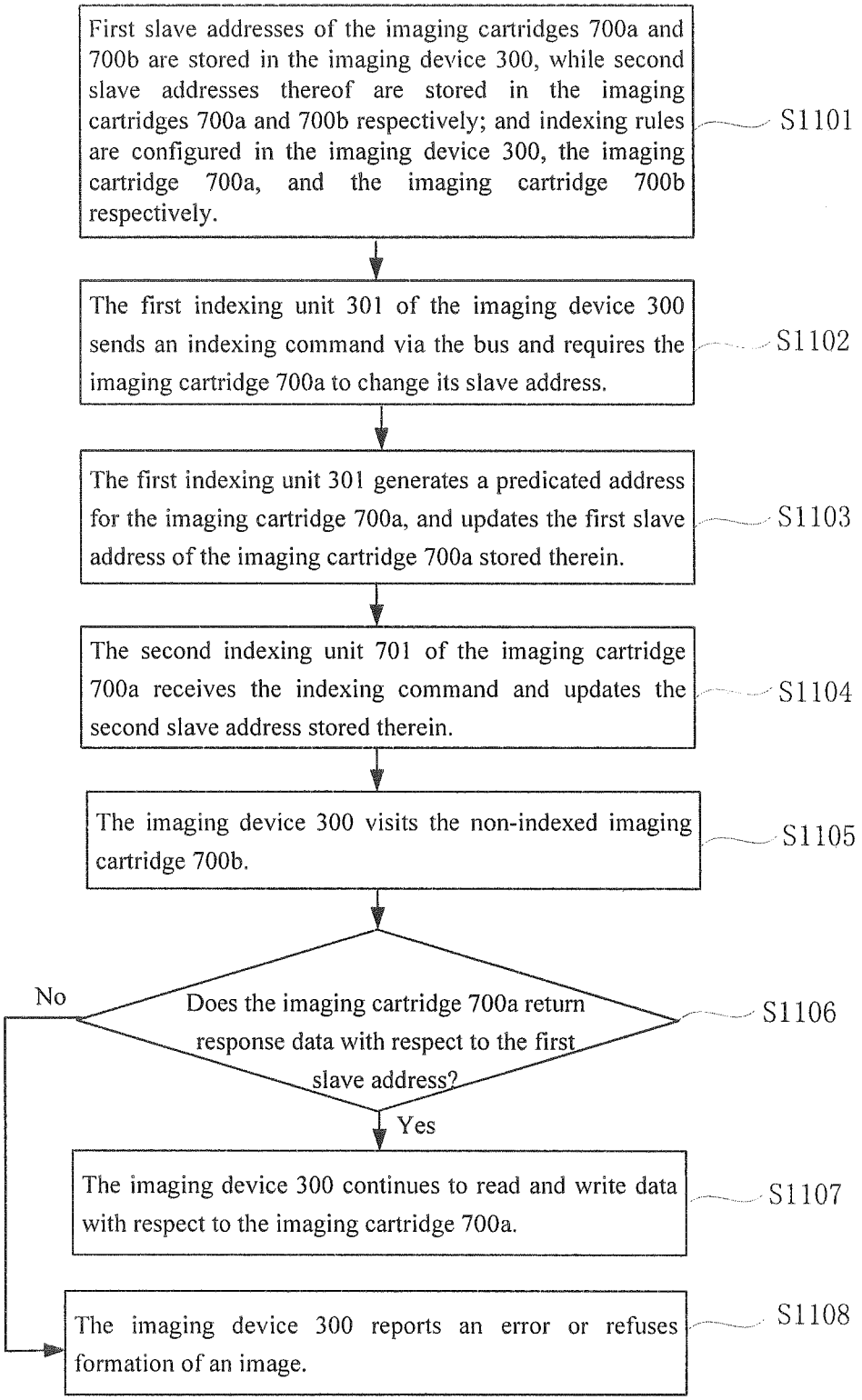
FIG. 11 shows a flow chart of a verification method of Embodiment 4.

FIG. 11 shows a flow chart of the verification method according to this embodiment, specifically comprising the following steps.

Step S1101, an initialization step, is the same as step S1001, and therefore will not be repeated herein.

In step S1102, the first indexing unit 301 of the imaging device 300 sends an indexing command via the bus, and requires the imaging cartridge 700*a* to change its slave address.

In step S1103, the first indexing unit 301 of the imaging device 300 generates a predicated address for the imaging cartridge 700*a* based on a first indexing rule, and updates the first slave address of the imaging cartridge 700*a* stored in the first indexing unit 301 on the basis of the predicated address.

In step S1104, the second indexing unit 701 of the imaging cartridge 700*a* receives the indexing command, and updates the second slave address stored in the second indexing unit 701 according to the second indexing rule.

In step S1105, the imaging device accesses the non-indexed imaging cartridge 700*b*.

Specifically, the verification unit 302 of the imaging device 300 sends addressing command that includes an initial address to the imaging cartridge 700*b*. The second indexing unit of the imaging cartridge 700*b* compares the initial address contained in the addressing command that has been received with the second slave address as stored. If the two are the same, then a response unit will send back response data 0 or 1 to the imaging device 300 via the bus.

Preferably, the imaging device 300 can continue to read and write data with respect to the imaging cartridge 700*b*, or/and the imaging device 300 will visit a non-indexed imaging cartridge 700*c*.

In step S1106, the verification unit 302 of the imaging device 300 sends an addressing command via the bus based on the first slave address stored in the first indexing unit 301 with respect to the imaging cartridge 700*a*, and judges whether response data are sent back. If yes, then the second slave address of the imaging cartridge 700*a* is judged to be correct, followed by execution of step S1107, while if no, i.e., no response data are sent back, the imaging cartridge 700*a* is judged to be invalid, followed by execution of step S1108.

In step S1107, the imaging device 300 continues to read and write data with respect to the imaging cartridge 700*a*.

In step S1108, the imaging device 300 reports an error or refuses formation of an image.

Step S1103 can be performed after step S1104 and before step S1105.

In this embodiment, the imaging device, after sending an indexing command to one imaging cartridge, does not immediately call the indexed imaging cartridge using an updated address that has been predicated, but rather sends the updated address via the bus after accessing other non-indexed imaging cartridges. As a result, a counterfeit imaging cartridge can be prevented from stealing the updated slave address.

Variant Embodiment 1

In Embodiment 1 as described above, two intermediate steps can be provided after the second indexing unit 701 of the imaging cartridge 700*a* receives an indexing command in step S804 and before the answer unit 702 of the imaging cartridge 700*a* sends back the indexing feedback data that include the second slave address to the imaging device 300 in step S805.

In one intermediate step, after the second indexing unit 701 updates the second salve address in step S804, the answer unit 702 of the imaging cartridge 700*a* automatically sends back indexing feedback data that include the second slave address to the imaging device 300, wherein the indexing feedback data constitute answer data with respect to the indexing rule.

In the other intermediate step, after the second indexing unit 701 of the imaging cartridge 700*a* updates the second slave address in step S804, the answer unit 702 does not send back indexing feedback data that include the second slave address to the imaging device 300. The second indexing unit 701 is provided with a change tag therein, and awaits a new indexing feedback command sent by the imaging device 300 via the bus. Specifically, the format of the indexing feedback command can be different from the format of the command as shown in FIG. 5, and may comprise merely a control portion, without an address portion. When the imaging cartridge 700*a* receives the indexing feedback command, due to the change tag stored in the second indexing unit 701, the answer unit 702 sends back indexing feedback data that include the second slave address to the imaging device 300 via the bus, and removes the change tag provided in the second indexing unit 701.

The other parts of this variant embodiment are the same as corresponding parts of Embodiment 1, and therefore will not be repeated herein.

Variant Embodiment 2

In step S1105 of Embodiment 4 as described above, the imaging device 300 may not access the non-indexed imaging cartridge 700*b* or 700*c*, but instead, adopts the initial address configured for the imaging cartridge 700*a* by the imaging device 300 in step S1101. The verification unit 302 sends an addressing command that includes the initial address of the imaging cartridge 700*a* via the bus. Since the second slave address of a normal imaging cartridge 700*a* has been updated in step S1104, the imaging cartridge 700*a* will not accept the addressing command that includes the initial address of the imaging cartridge 700*a*, nor send back any response data thereto. As a result, the imaging device 300, after sending the addressing command that includes the initial address of the imaging cartridge 700*a* via the bus, will determine whether response data have been received. If yes, the imaging cartridge 700*a* will be determined to be invalid, followed by execution of step S1108, while if no, i.e., no response data have been returned, the second slave address of the imaging cartridge 700*a* will be determined to be correct and tentatively valid, followed by execution of step S1106.

The other parts of this variant embodiment are the same as corresponding parts of Embodiment 4, and therefore will not be repeated herein.

While the embodiments of the present disclosure are described above, the description should not be construed as limitations of the present disclosure, but merely as embodiments for readily understanding the present disclosure. Anyone skilled in the art, within the spirit and scope of the present disclosure, can make amendments or modification to the implementing forms and details of the embodiments. Hence, the scope of the present disclosure should be subject to the scope defined in the claims.

The invention claimed is:

1. A method for an imaging device to verify an imaging cartridge, comprising storing a first slave address of the imaging cartridge and configuring a first indexing rule in the imaging device, wherein the method further comprises:

an indexing step, including sending an indexing command to the imaging cartridge, generating a predicated address for the imaging cartridge based on the first indexing rule and the indexing command, and updating the first slave address of the imaging cartridge based on the predicated address; and a verification step, including judging whether a second slave address of the imaging cartridge is correct according to answer data sent by the imaging cartridge, or according to the answer data sent by the imaging cartridge as well as the first slave address of the imaging cartridge;

wherein the answer data comprise indexing feedback data that include the second slave address of the imaging cartridge, or response data with respect to an addressing command that includes the first slave address of the imaging cartridge.

2. The method according to claim 1, wherein the verification step comprises:

determining whether the second slave address of the imaging cartridge is correct by judging whether the second slave address included in the indexing feedback data that are sent by the imaging cartridge is the same as the first slave address of a corresponding imaging cartridge as stored through comparison therebetween; or sending the addressing command that includes the first slave address via a bus, and judging whether the second slave address of the imaging cartridge is correct according to whether the corresponding imaging cartridge sends back response data with respect to the addressing command.

3. The method according to claim 2, wherein the indexing step comprises sending a plurality of consecutive indexing commands for one and the same imaging cartridge, generating a plurality of predicated addresses based on said plurality of consecutive indexing commands for said imaging cartridge, and updating a plurality of first slave addresses of said imaging cartridge based on the plurality of predicated addresses; and wherein the verification step comprises sending addressing commands via the bus according to the plurality of first slave addresses for said imaging cartridge, and judging whether the second slave address of the imaging cartridge is correct according to whether the corresponding imaging cartridge sends back response data with respect to a latest first slave address only.

4. The method according to claim 2, wherein the indexing step comprises sending indexing commands for a plurality of imaging cartridges, generating a plurality of predicated addresses based on said indexing commands for the plurality of imaging cartridges, and updating first slave addresses of the plurality of imaging cartridges respectively; and wherein the verification step comprises sending addressing commands via the bus according to the first slave addresses of the plurality of imaging cartridges, and judging whether second slave addresses of the imaging cartridges are correct according to whether corresponding plurality of imaging cartridges each send back response data with respect to the respective first slave addresses.

5. The method according to claim 1, wherein a step of accessing a non-indexed imaging cartridge is further provided between the indexing step and the verification step.

6. The method according to claim 1, wherein the first indexing rule comprises an address generation rule or an indexing sequence table.

7. An imaging device comprising:

a first indexing unit, used for storing a first slave address of an imaging cartridge and configuring a first indexing rule, sending an indexing command to the imaging cartridge, generating a predicated address for the imaging cartridge according to the first indexing rule and the indexing command, and updating the first slave address of the imaging cartridge based on the predicated address; and a verification unit, used for judging whether a second slave address of the imaging cartridge is correct according to answer data sent by the imaging cartridge, or according to the answer data sent by the imaging cartridge as well as the first slave address of the imaging cartridge;

wherein the answer data comprise indexing feedback data that include the second slave address of the imaging cartridge, or response data with respect to an addressing command that includes the first slave address of the imaging cartridge.

8. The device according to claim 7, wherein the verification unit is further used for:

determining whether the second slave address of the imaging cartridge is correct by judging whether the second slave address included in the indexing feedback data that are sent by the imaging cartridge is the same as the first slave address of a corresponding imaging cartridge as stored through comparison therebetween; or sending the addressing command that includes the first slave address via a bus, and judging whether the second slave address of the corresponding imaging cartridge is correct according to whether the imaging cartridge sends back response data with respect to the addressing command only.

9. The device according to claim 8, wherein a plurality of consecutive indexing commands is sent to one and the same imaging cartridge;

wherein the first indexing unit is further used for generating a plurality of predicated addresses according to the plurality of consecutive indexing commands for one and the same imaging cartridge, and for updating a plurality of first slave addresses of said imaging cartridge based on the plurality of predicated addresses; and wherein the verification unit is further used for sending an addressing command via the bus according to the plurality of first slave addresses for said imaging cartridge, and judging whether the second slave address of the corresponding imaging cartridge is correct according to whether the imaging cartridge feeds back response data with respect to a latest first slave address.

10. The device according to claim 8, wherein indexing commands are sent for a plurality of imaging cartridges;

wherein the first indexing unit is further used for generating a plurality of predicated addresses based on the indexing commands for the plurality of imaging cartridges, and for updating the first salve addresses of the imaging cartridges based on the plurality of predicated addresses, respectively; and wherein the verification unit is further used for sending addressing commands via the bus according to the first slave addresses of the plurality of imaging cartridges, and judging whether the second slave addresses of corresponding imaging cartridges are correct according to whether the corresponding imaging cartridges each send back response data with respect to respective first slave addresses.

11. The device according to claim 7, wherein the verification unit is further used for visiting a non-indexed imaging cartridge.

12. The device according to claim 7, wherein the first indexing rule comprises an address generation rule or an indexing sequence table.

13. A method for an imaging cartridge to accept verification of an imaging device, comprising storing a second slave address of the imaging cartridge and configuring a second indexing rule in the imaging cartridge, wherein the method further comprises:

an indexing step, including accepting an indexing command sent by the imaging device, and updating the second slave address of the imaging cartridge according to the second indexing rule and the indexing command; and an answering step, including sending answer data to the imaging device, wherein the answer data comprise indexing feedback data that include the second slave address of the imaging cartridge, or response data with respect to an addressing command which includes a first slave address of the imaging cartridge.

14. The method according to claim 13, wherein the second indexing rule comprises an address generation rule or an indexing sequence table.

15. An imaging cartridge, comprising:

a second indexing unit, used for storing a second slave address of the imaging cartridge and configuring a second indexing rule, and for updating the second slave address based on the second indexing rule and an indexing command to be received; and an answer unit, used for sending answer data to an imaging device, wherein the answer data comprise indexing feedback data that include the second slave address of the imaging cartridge, or response data to an addressing command that includes a first slave address of the imaging cartridge.

16. The imaging cartridge according to claim 15, wherein the second indexing rule comprises an address generation rule or an indexing sequence table.

* * * * *